US010480783B2

(12) United States Patent
Kowald

(10) Patent No.: US 10,480,783 B2
(45) Date of Patent: Nov. 19, 2019

(54) POSITIVE PRESSURE AMPLIFIED GAS-AIR VALVE FOR A LOW NOX PREMIX COMBUSTION SYSTEM

(71) Applicant: Lennox Industries Inc., Richardson, TX (US)

(72) Inventor: Glenn W. Kowald, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 170 days.

(21) Appl. No.: 15/690,509

(22) Filed: Aug. 30, 2017

(65) Prior Publication Data

US 2019/0063742 A1 Feb. 28, 2019

(51) Int. Cl.

| | |
|---|---|
| ***F23D 14/04*** | (2006.01) |
| ***F24H 9/18*** | (2006.01) |
| ***F24H 3/06*** | (2006.01) |
| ***F24D 5/04*** | (2006.01) |
| ***F23N 1/02*** | (2006.01) |
| ***F24H 3/08*** | (2006.01) |

(52) U.S. Cl.

CPC ..... *F23D 14/04* (2013.01); *F23N 1/027* (2013.01); *F24D 5/04* (2013.01); *F24H 3/065* (2013.01); *F24H 3/087* (2013.01); *F24H 9/1881* (2013.01); *F23N 2035/20* (2013.01)

(58) Field of Classification Search

CPC ..... F23D 14/04; F24D 5/04
USPC ..... 126/110 C, 116 A, 41 R
See application file for complete search history.

(56) References Cited

U.S. PATENT DOCUMENTS

| | | | | |
|---|---|---|---|---|
| 4,677,357 | A * | 6/1987 | Spence | F23N 5/184 110/189 |
| 5,136,950 | A * | 8/1992 | Halpin | F42B 4/26 102/324 |
| 5,186,386 | A * | 2/1993 | Lynch | F23N 5/203 236/11 |
| 5,866,840 | A * | 2/1999 | Briere | F42B 4/26 102/336 |
| 8,683,993 | B2 * | 4/2014 | Paller | F24H 3/087 126/110 R |
| 8,777,608 | B2 * | 7/2014 | Wah | F23N 5/105 126/39 BA |
| 9,335,045 | B2 * | 5/2016 | Kowald | F23N 3/082 |
| 2006/0260603 | A1 * | 11/2006 | Shah | A47J 37/0713 126/41 R |
| 2011/0100349 | A1 * | 5/2011 | Hugghins | F23N 1/022 126/116 A |

(Continued)

*Primary Examiner* — Gregory L Huson
*Assistant Examiner* — Nikhil P Mashruwala
(74) *Attorney, Agent, or Firm* — Baker Botts L.L.P.

(57) ABSTRACT

Systems and methods are described related to a premix combustion system used in a furnace system. Prior systems have to create a negative pressure in the premix chamber to draw gas into the chamber. Embodiments under the current disclosure can use an amplifier that is pneumatically coupled to an air supply and a secondary location (besides the gas valve). Coupling to the amplifier to a location apart from the gas valve allows the system to avoid a negative pressure in the mixing chamber. The amplifier can apply an amplified pressure or signal to a gas valve regulator and thereby raise the gas pressure so that the gas supply is driven into the premix chamber.

21 Claims, 5 Drawing Sheets

(56) References Cited

U.S. PATENT DOCUMENTS

| | | | | |
|---|---|---|---|---|
| 2012/0199109 | A1* | 8/2012 | Thompson | F27D 19/00 126/112 |
| 2014/0061322 | A1* | 3/2014 | Hrejsa | G05D 23/1932 236/11 |

* cited by examiner

POSITIVE PRESSURE AMPLIFIED GAS-AIR VALVE FOR A LOW NOX PREMIX COMBUSTION SYSTEM

TECHNICAL FIELD

The present disclosure is directed to heating, ventilation and air conditioning systems (HVAC), and more particularly to premixes for furnaces.

BACKGROUND OF THE INVENTION

A low NOx premix combustion system typically requires the gas-air linkage to maintain a consistent gas-air ratio at different firing rates (2-stage or modulating). Traditionally, a negative regulator type gas valve is applied to provide this control linkage. Such a regulator will be pneumatically coupled to both the air supply and the fuel supply. The mixing chamber will receive the air supply downstream of the regulator coupling and direct the air through flow restrictors (or another component) that lowers the pressure in that portion of the mixing chamber. The fuel supply will enter through an inlet in the portion of the mixing chamber with a lowered pressure. Because the air supply and fuel supply were at equal pressures prior to the flow restrictors, the lowered pressure created by the flow restrictors helps to draw the fuel supply into the mixing chamber. Typically, high negative pressures provide better overall performance, but at a penalty of increased pressure drop.

BRIEF SUMMARY OF THE INVENTION

One embodiment under the present disclosure comprises a premix combustion system for a furnace in an HVAC system, comprising: a chamber operable to receive gas and air and deliver a gas-air mix to a combustion chamber, the chamber comprising an air inlet operable to receive an air supply; a gas valve, the gas valve comprising a gas line extending from the gas valve to the chamber at a location downstream from the air inlet, the gas valve further comprising a gas supply inlet operable to receive gas from a gas source; a regulator comprising; an air interface pneumatically coupled to the air supply; a secondary interface proximate the air interface and pneumatically coupled to a secondary location in the HVAC system; and a regulator linkage coupled to the gas valve, the regulator linkage configured to detect a pressure differential between the air supply and the secondary location, and to cause the gas valve to apply an amplified pressure to gas in the gas line.

Another possible embodiment under the present disclosure comprises a furnace for use in an HVAC system, comprising: a premix combustion system, comprising; a chamber operable to receive gas and air and deliver a gas-air mix to a combustion chamber, the chamber comprising an air inlet operable to receive an air supply; a gas valve, the gas valve comprising a gas line extending from the gas valve to the chamber at a location downstream from the air inlet, the gas valve further comprising a gas supply inlet operable to receive gas from a gas source; a regulator comprising; an air interface pneumatically coupled to the air supply; a secondary interface proximate the air interface and pneumatically coupled to a secondary location in the HVAC system; and a regulator linkage coupled to the gas valve, the regulator linkage configured to detect a pressure differential between the air supply and the secondary location, and to cause the gas valve to apply an amplified pressure to gas in the gas line; one or more heat exchangers operable to receive combusted gas-air mix from the combustion chamber; one or more inducers operable to induce the flow of combusted gas-air mix through the one or more heat exchangers; one or more blowers operable to direct air flow across the one or more heat exchangers; and an exhaust operable to direct combusted gas-air mix from the one or more heat exchangers to an exhaust vent.

Another possible embodiment under the present disclosure comprises a method of operating a furnace in an HVAC system, comprising: providing a premix chamber configured to receive an air supply and a gas supply and to supply a gas-air mix to a combustion chamber; providing a gas valve comprising a gas supply inlet configured to receive the gas supply from a gas source and a gas line configured to deliver the gas supply to the premix chamber; receiving the air supply in the premix chamber at an air inlet; receiving the gas supply in the premix chamber from the gas line connected to the premix chamber downstream of the air inlet; providing a regulator operable to detect a pressure differential between a first interface and a second interface, and further operable to apply an amplification of the pressure differential to the gas supply in the gas line; coupling the first interface pneumatically to the air supply; coupling the second interface pneumatically to a secondary location in the HVAC system; receiving the gas-air mix in the combustion chamber; igniting the gas-air mix in the combustion chamber; and providing the ignited gas-air mix to another component of the furnace.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

As stated, a negative regulator is typically used in a low NOx premix combustion system, as this is necessary to induce gas flow through the metering orifice. Embodiments under the present disclosure can improve upon the prior art by using a positive pressure amplified gas-air valve. This gas valve provides a positive gas manifold pressure through the gas metering orifice and as a result a negative pressure in the chamber to induce gas flow is optional and not required. Positive pressures in the mixing chamber can also be used because the pressure applied to the gas supply will be stepped up or amplified by a regulator to increase the gas pressure as compared to the air supply pressure or mixing chamber pressure. In embodiments under the present disclosure, the effective pressure across the gas metering orifice can be higher (preferably 4 times higher), which provides improvements in firing rate control, gas-air mixing, and ignition. Embodiments can also have the safety benefit of limiting maximum gas manifold pressure to prevent over-firing through the use of a conventional positive pressure type regulator. In contrast, a conventional negative-regulator system has no such limit on firing rate, and can drastically over-fire if negative pressures become excessive. In addition, since a negative pressure in the mixing chamber is not required, the improved system offers the ability to reduce system pressure drop by utilizing pressure sources upstream or downstream of the mixing chamber that may already be present in the system (such as inducer, hot box, cold end header box, venturi tube or flow meter) to control firing rate rather than an inlet orifice or other flow restriction which is required for the negative regulator system. Another unique feature of this system is the ability to use a positive signal pressure to the gas valve rather than the traditional negative to drive regulation providing and additional degree of system design freedom.

Figure 1:
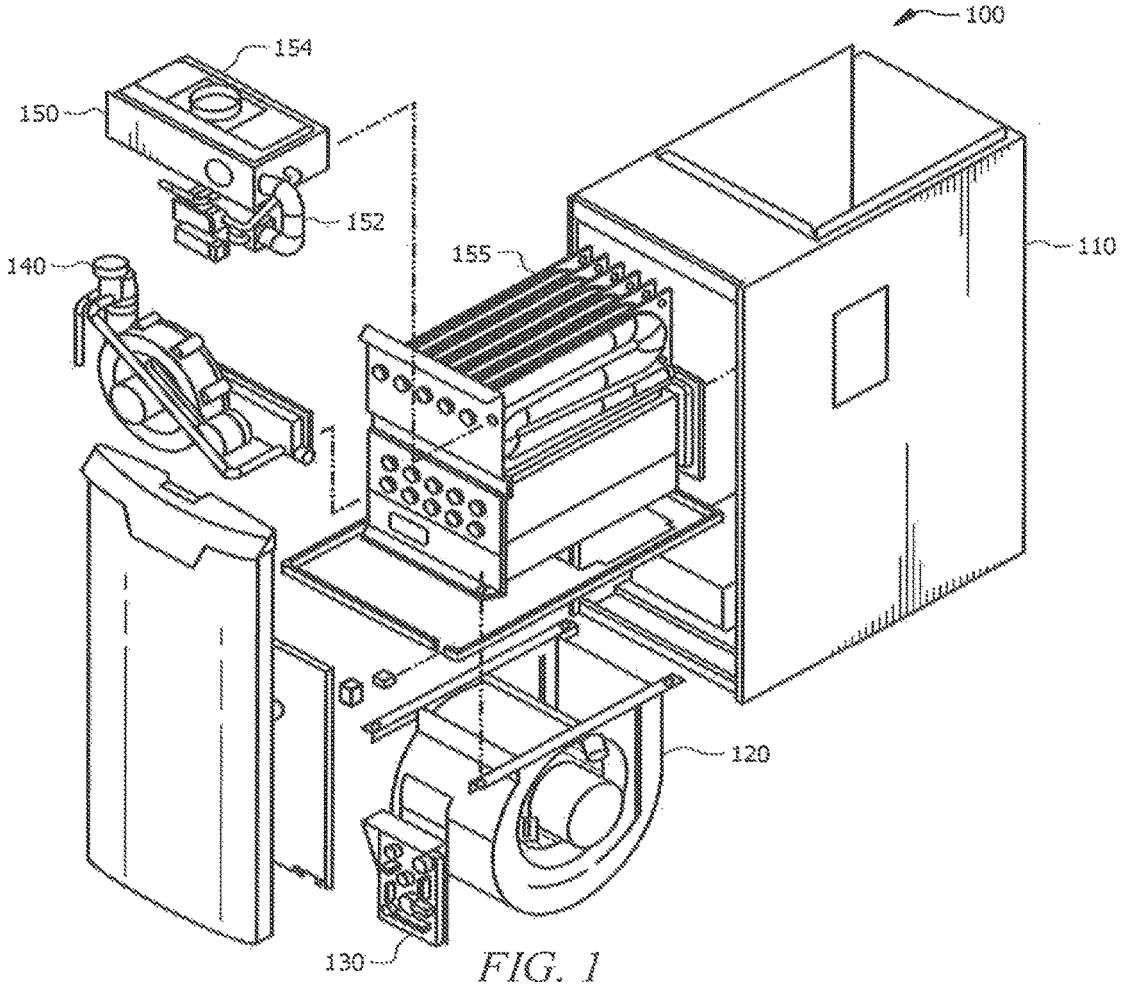
FIG. 1 (PRIOR ART)
FIG. 1 is a diagram of a prior art embodiment.

Referring now to FIG. 1, a prior art furnace can be shown. Furnace 100 comprises a cabinet 110, blower 120, controller panel 130, inducer/exhaust 140, burner compartment 150, gas supply 152, air supply 154, combination combustion chamber/heat exchanger 155. The burner compartment 150 can house an igniter (not shown) which ignites the mix of gas and air. Combusted air and gas then travel through the combustion chamber/heat exchangers 155 in a serpentine path. Air blown across the combustion chamber/heat exchangers 155 by the blower 120 will transfer heat with the combustion chamber/heat exchangers 155. Combusted matter will then exit via exhaust 140.

Figure 2:
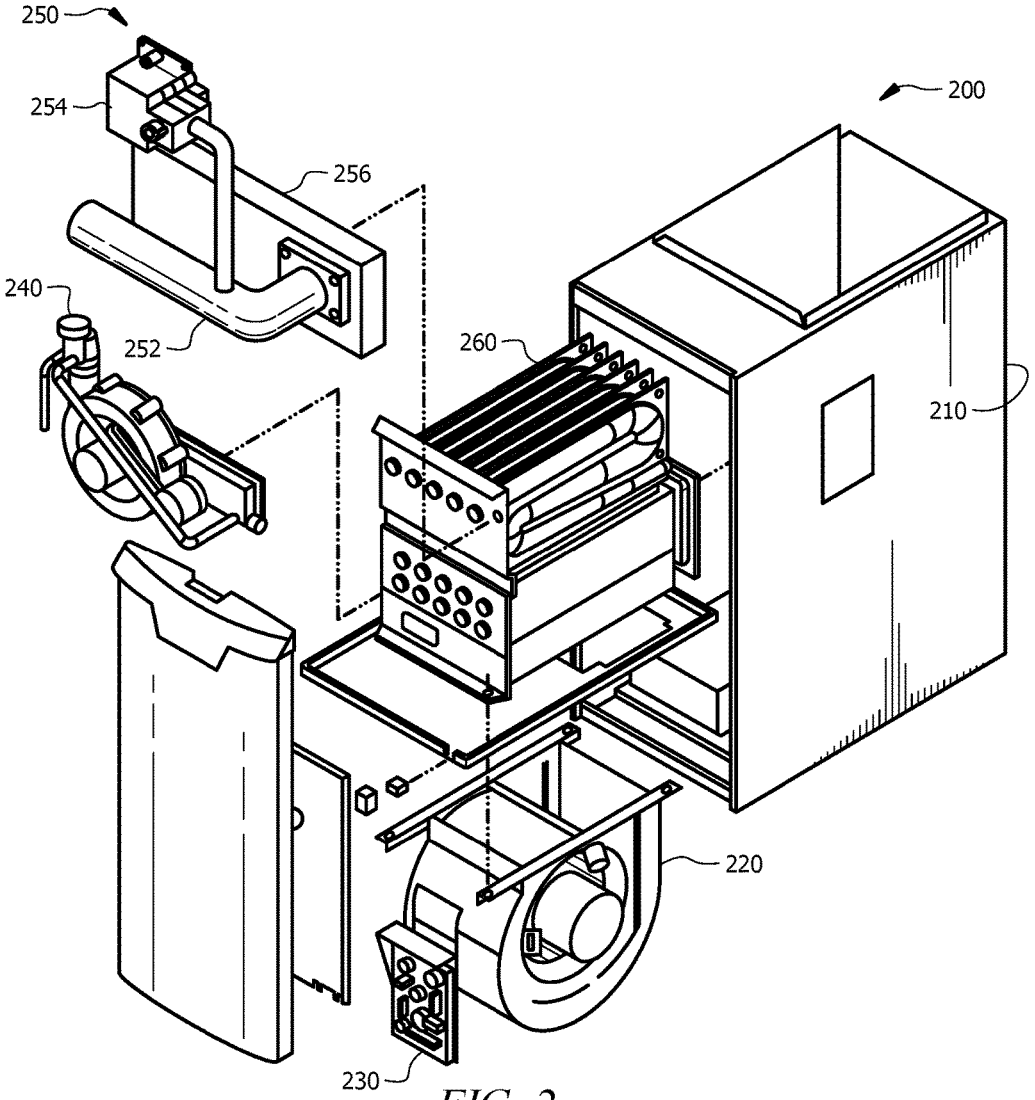
FIG. 2 is a diagram of a furnace embodiment under the present disclosure.

A furnace with a premix system is shown in FIG. 2. Such a system can comprise an example embodiment under the present disclosure. Furnace 200 comprises a cabinet 210, blower 220, controller/circuitry 230, exhaust/inducer 240, premix combustion system 250, and heat exchangers 260. Premix 250 combustion system comprises an air inlet 252, gas valve 254, and combustion chamber 256. Gas and air mixes in the premixer before reaching the burner assembly 256. Other layouts, geometries, sizes, and versions of premixers and combustion chambers can be used in embodiments under the present disclosure.

Figure 3:
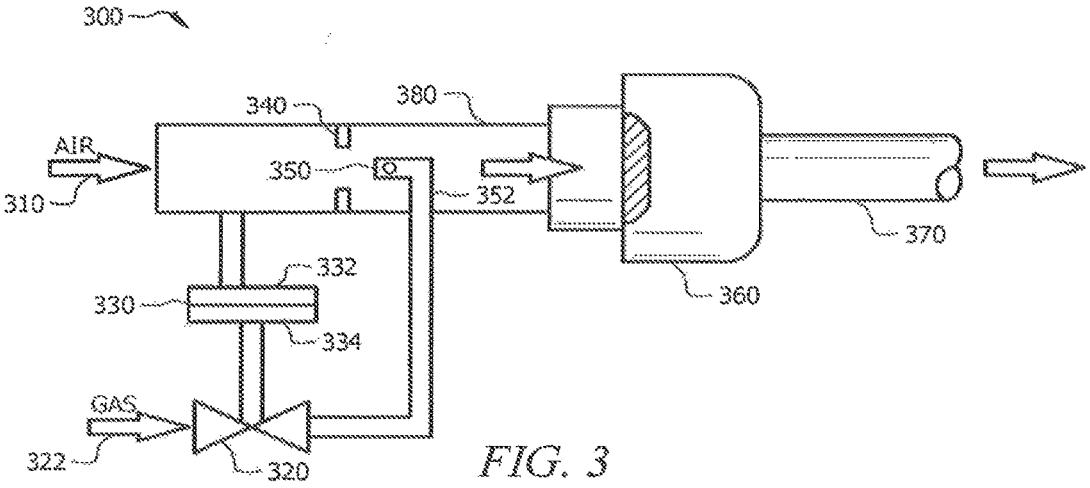
FIG. 3 (PRIOR ART)
FIG. 3 is a diagram of a prior art embodiment.

An embodiment of a prior-art premix combustion system 300 is shown in FIG. 3. Premix 300 has an air inlet 310 and a gas supply 322 at gas valve 320. Gas enters the premix chamber 380 at gas inlet 350 via orifice 352. This allows the gas and air to mix prior to combustion chamber 360, where the mix of gas and air is ignited and then conveyed to a heat exchanger or other component by connection 370. Flow restrictors 340 are typically used in prior art systems to assist in creating a negative pressure in chamber 380 relative to gas valve 320. Orifice 352 will typically be sized to match the negative pressure in the chamber 380. Regulator 330 has an air face 332 and a gas face 334 that are in communication with the air and gas entering the system. The regulator 330 being in communication with the gas and the air streams maintains the correct ratio gas to the amount of air present regardless of rise and fall pressure in chamber 380. Negative pressure in chamber 380 is communicated back to regulator 330 and diaphragm 334 via orifice 352 and gas inlet 350. Without a negative pressure in chamber 380, the gas would not be driven into chamber 380.

Figure 4:
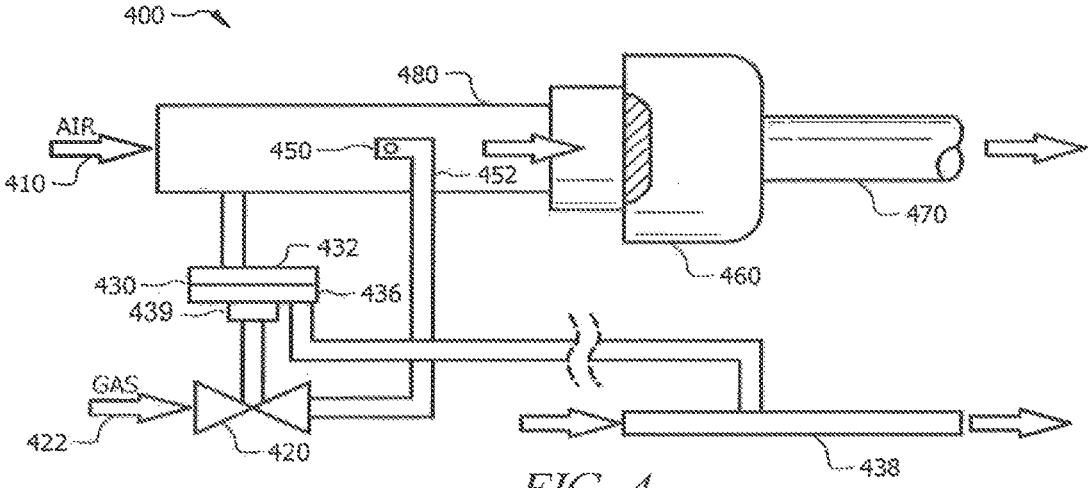
FIG. 4 is a diagram of a premix embodiment under the present disclosure.

FIG. 4 displays an embodiment of a premix combustion system 400 under the present disclosure. Premix combustion system 400 comprises an air inlet 410 and an amplified gas-air valve 420 with a gas supply 422. Gas inlet 450 delivers gas to the chamber 480 via orifice 452. Chamber 480 can comprise flow restrictors, such as in FIG. 3, but they are not necessary. Gas and air can mix in chamber 480 and then proceed to combustion chamber 460, and then to connection 470 for delivery to heat exchanger tubes or other components. Amplifier diaphragm 430 comprises an air face 432 and a secondary face 436. In FIG. 3, the secondary face was in communication with the gas supply and therefore balanced the gas pressure and the air pressure. In the embodiment of FIG. 4 the secondary face 436 is coupled to another location 438 in the system. For example, location 438 can be a portion of a heat exchanger, outlet tube, exhaust tube or vent, or elsewhere that is upstream or downstream of the premix 400. As amplifier diaphragm 430 is coupled to regulator 439, the pressure difference between amplifier diaphragms 432 and 436 creates a force imparted to Regulator 439. Amplifier diaphragm 430 can provide an amplifying mechanism to regulator 439 that increases the gas pressure gas valve 420 can apply to gas being supplied to gas inlet 450. In FIG. 3, gas pressure matches the pressure in chamber 380, necessitating a negative pressure in the chamber 380 to create gas flow. Because the gas pressure is a positive value in FIG. 4, a negative pressure is not needed in chamber 480 to create gas flow. Amplifier diaphragm 430 coupled to Regulator 439 can create an amplifying effect to the gas supply, raising the gas pressure above that of the air pressure delta applied to diaphragm 430. Through trial and error, it has been found that, for some systems, an amplification of 4:1 is ideal. This may be limited to the tested geometry and system layout. Other amplifications factors can be used depending on the embodiment.

Other embodiments under the present disclosure could move the gas inlet 450 upstream of the air inlet 410. This can provide an additional advantage by providing users with more design flexibility.

One benefit of embodiments under the present disclosure is that, depending on the location 438 providing pressure to secondary face 436, the system may automatically shut down during dangerous operations or situations. For example, location 438 could be placed on an outlet or exhaust with 1 inch of pressure. If somehow the outlet or exhaust were unintentionally and otherwise unknowingly disconnected, then the location 438 would be exposed to atmospheric pressure (0 inch pressure). In such a situation gas valve 420 would be shut off by the regulator 439, thereby shutting down the system. Another benefit of the embodiments is the capability of applying an optional outlet pressure regulator to limit the maximum outlet pressure possible in the event of excessive amplifier pressure which would typically result in an unsafe over-firing condition.

Figure 5:
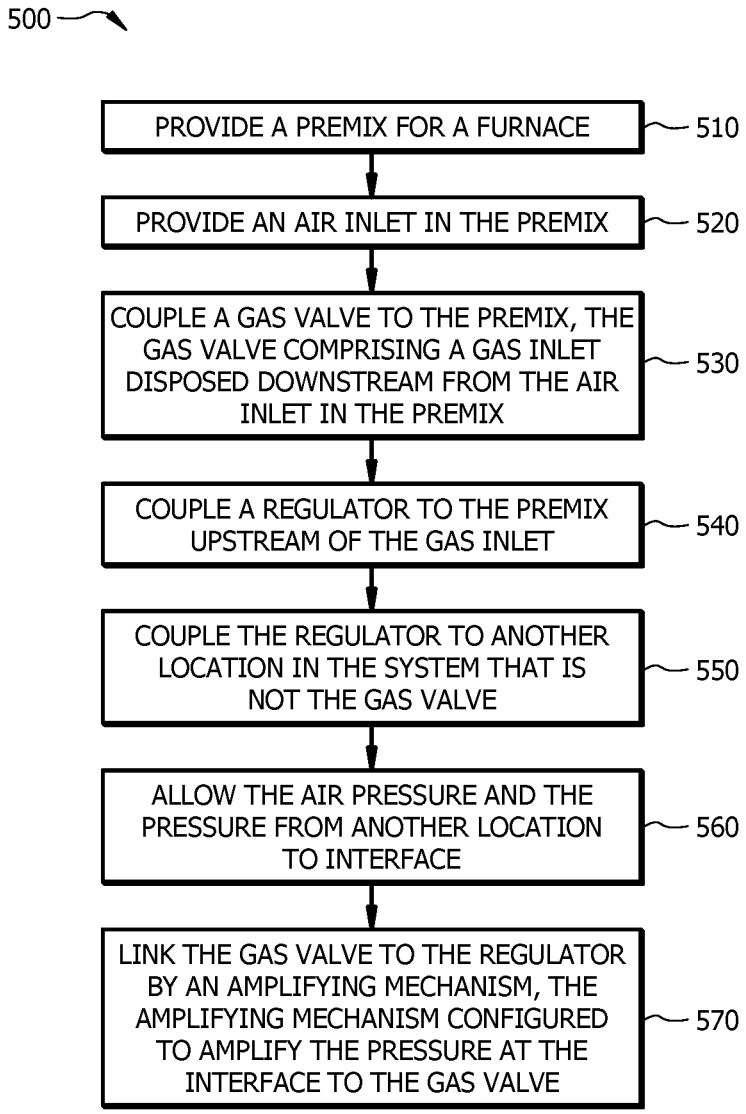
FIG. 5 is a flow chart diagram of a method embodiment under the present disclosure.

FIG. 5 displays a possible method embodiment 500 under the present disclosure. At 510, a premix system is provided for a furnace or an HVAC system. At 520, an air inlet is provided in the premix system. At 530, a gas valve is coupled to the premix system by providing a gas inlet in the premix system downstream from the air inlet. At 540, a regulator is coupled to the premix system upstream of the gas inlet. At 550, the regulator is coupled to another location in the system that is not the gas valve. At 560, the air pressure and the pressure from another location are allowed to interface in the regulator, such as across a membrane or another type of interface. At 570, the gas valve is linked to the regulator, the regulator is linked to an amplifying mechanism, the amplifying mechanism configured to amplify the gas pressure supplied by the gas valve. An amplifier can comprise a physical linkage that responds to pressure at the interface.

Figure 6:
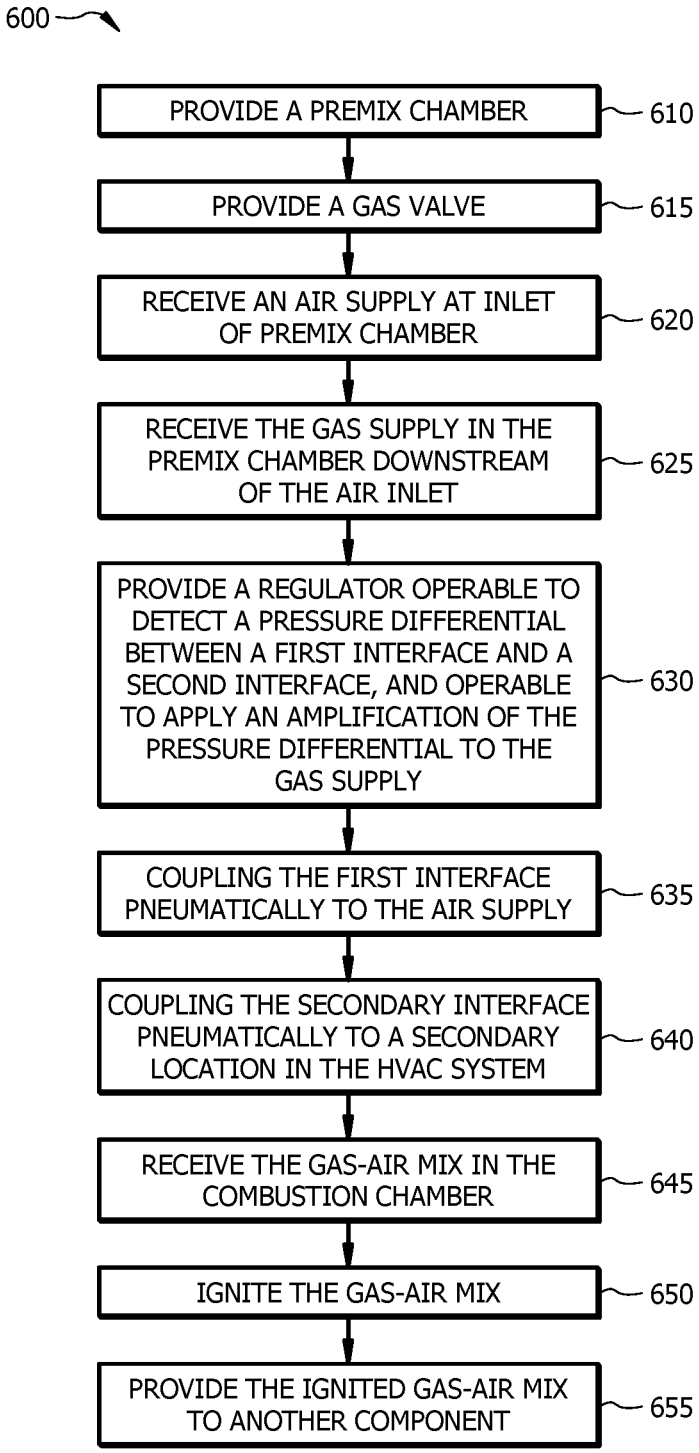
FIG. 6 is a flow chart diagram of a method embodiment under the present disclosure.

FIG. 6 displays a possible method embodiment 600 under the present disclosure. At 610, a premix chamber is provided, the premix chamber configured to receive an air supply and a gas supply and to supply a gas-air mix to a combustion chamber. At 615, a gas valve is provided, the gas valve comprising a gas supply inlet configured to receive the gas supply from a gas source and a gas line configured to deliver the gas supply to the premix chamber. At 620, the air supply is received in the premix chamber at an air inlet. At 625, the gas supply is received in the premix chamber from the gas line connected to the premix chamber downstream of the air inlet. At 630, a regulator is provided, the regulator operable to detect a pressure differential between a first interface and a second interface, and further operable to apply an amplification of the pressure differential to the gas supply in the gas line. At 635, the first interface is pneumatically coupled to the air supply. At 640, the second interface is pneumatically coupled to a secondary location in the HVAC system that preferably does not comprise premix chamber. At 645, the gas-air mix is received in the combustion chamber. At 650, the gas-air mix is ignited in the combustion chamber. At 655, the ignited gas-air mix is provided to another component of the furnace.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A premix combustion system for a furnace in an HVAC system, comprising: a chamber operable to receive gas and air and deliver a gas-air mix to a combustion chamber, the chamber comprising an air inlet operable to receive an air supply; a gas valve, the gas valve comprising a gas line extending from the gas valve to the chamber at a location downstream from the air inlet, the gas valve further comprising a gas supply inlet operable to receive gas from a gas source; an amplifier comprising; an air interface pneumatically coupled to the air supply; a secondary interface proximate the air interface and pneumatically coupled to a secondary location in the HVAC system; and a regulator coupled to the amplifier and coupled to the gas valve; wherein the amplifier is configured to detect a pressure differential between the air supply and the secondary location, and to cause the regulator coupled to the gas valve to apply an amplified pressure to gas in the gas line.

2. The premix of claim 1 wherein the secondary location comprises an outlet.

3. The premix of claim 1 wherein the secondary location comprises an exhaust line.

4. The premix of claim 1 wherein the chamber comprises flow restrictors.

5. The premix of claim 1 wherein the regulator linkage applies a 4:1 amplification to the gas valve.

6. The premix of claim 3 wherein if the secondary location is exposed to atmospheric pressure then the regulator turns off the gas valve.

7. The premix of claim 1 wherein the secondary location is in the chamber downstream of the air inlet.

8. The premix of claim 1 wherein the regulator further comprises a membrane between the air interface and the secondary interface.

9. A furnace for use in an HVAC system, comprising: a premix combustion system, comprising; a chamber operable to receive gas and air and deliver a gas-air mix to a combustion chamber, the chamber comprising an air inlet operable to receive an air supply; a gas valve, the gas valve comprising a gas line extending from the gas valve to the chamber at a location downstream from the air inlet, the gas valve further comprising a gas supply inlet operable to receive gas from a gas source; an amplifier comprising; an air interface pneumatically coupled to the air supply; a secondary interface proximate the air interface and pneumatically coupled to a secondary location in the HVAC system; and a regulator coupled to the amplifier and to the gas valve, wherein the amplifier is configured to detect a pressure differential between the air supply and the secondary location, and to cause the regulator coupled to the gas valve to apply an amplified pressure to gas in the gas line; one or more heat exchangers operable to receive combusted gas-air mix from the combustion chamber; one or more inducers operable to induce the flow of combusted gas-air mix through the one or more heat exchangers; one or more blowers operable to direct air flow across the one or more heat exchangers; and an exhaust operable to direct combusted gas-air mix from the one or more heat exchangers to an exhaust vent.

10. The furnace of claim 9 wherein the secondary location comprises an outlet.

11. The furnace of claim 9 wherein the secondary location comprises an exhaust line.

12. The furnace of claim 9 wherein the chamber comprises flow restrictors.

13. The furnace of claim 9 wherein the amplifier coupled to the regulator applies a 4:1 amplification to the gas valve.

14. The furnace of claim 11 wherein if the secondary location is exposed to atmospheric pressure then the regulator turns off the gas valve.

15. The furnace of claim 9 wherein the secondary location is in the chamber downstream of the air inlet.

16. The furnace of claim 9 wherein the amplifier further comprises a membrane between the air interface and the secondary interface.

17. A method of operating a furnace in an HVAC system, comprising: providing a premix chamber configured to receive an air supply and a gas supply and to supply a gas-air mix to a combustion chamber; providing a gas valve comprising a gas supply inlet configured to receive the gas supply from a gas source and a gas line configured to deliver the gas supply to the premix chamber; receiving the air supply in the premix chamber at an air inlet; receiving the gas supply in the premix chamber from the gas line connected to the premix chamber downstream of the air inlet; providing an amplifier operable to detect a pressure differential between a first interface and a second interface, coupling the amplifier to the regulator and further operable to apply a pressure differential to the gas supply in the gas line; coupling the first interface pneumatically to the air supply; coupling the second interface pneumatically to a secondary location in the HVAC system; receiving the gas-air mix in the combustion chamber; igniting the gas-air mix in the combustion chamber; and providing the ignited gas-air mix to another component of the furnace.

18. The method of claim 17 wherein the secondary location comprises an exhaust line.

19. The method of claim 17 wherein the secondary location comprises a location in the premix chamber downstream from the gas inlet.

20. The method of claim 17 wherein the regulator linkage applies a 4:1 amplification to the gas valve.

21. The method of claim 17 wherein the regulator comprises a membrane between the first and second interface.

* * * * *